US008944867B2

(12) United States Patent
Grovender

(10) Patent No.: US 8,944,867 B2
(45) Date of Patent: Feb. 3, 2015

(54) DEVICES AND METHODS FOR ADJUSTING WATERCRAFT TRANSOM HEIGHT

(71) Applicant: David L. Grovender, North Branch, MN (US)

(72) Inventor: David L. Grovender, North Branch, MN (US)

(73) Assignee: Premier Marine, Inc., Wyoming, MN (US)

( * ) Notice: Subject to any disclaimer, the term of this patent is extended or adjusted under 35 U.S.C. 154(b) by 58 days.

(21) Appl. No.: 13/655,027

(22) Filed: Oct. 18, 2012

(65) Prior Publication Data

US 2014/0113514 A1 Apr. 24, 2014

(51) Int. Cl.
*B63H 20/02* (2006.01)
*B63H 20/06* (2006.01)

(52) U.S. Cl.
CPC ..... *B63H 20/02* (2013.01); *B63H 20/06* (2013.01)
USPC ..... 440/53; 248/641

(58) Field of Classification Search
USPC ..... 440/53, 61 R, 61 D; 248/640, 641, 642, 248/643
See application file for complete search history.

(56) References Cited

U.S. PATENT DOCUMENTS

| | | | | | |
|---|---|---|---|---|---|
| 4,232,627 | A * | 11/1980 | Glenn et al. | ..... | 440/61 R |
| 4,482,330 | A * | 11/1984 | Cook | ..... | 440/61 R |
| 4,624,438 | A * | 11/1986 | Goodman, Jr. | ..... | 248/642 |
| 5,100,349 | A * | 3/1992 | Perkins et al. | ..... | 440/61 R |
| 6,409,556 | B1 * | 6/2002 | Vance | ..... | 440/61 R |
| 8,267,025 | B2 * | 9/2012 | Witte | ..... | 248/641 |
| 8,627,779 | B2 * | 1/2014 | Witte | ..... | 248/641 |

* cited by examiner

*Primary Examiner* — Lars A Olson
(74) *Attorney, Agent, or Firm* — Winthrop & Weinstine, P.A.

(57) ABSTRACT

The invention provides devices and methods for providing a watercraft transom having an adjustable transom height feature allowing optimal matching with the drive shaft of the watercraft's motor. In one embodiment, the adjustable transom height feature comprises two transom height settings to accommodate long or extra long drive shafts or, alternatively short or long or, still more alternatively, short or extra long drive shafts. In another embodiment, the adjustable transom height feature comprises more than two transom height settings, preferably to include matching transom height to known and available outboard motor drive shafts in order to accommodate and virtually optimize any drive shaft length.

14 Claims, 6 Drawing Sheets

DEVICES AND METHODS FOR ADJUSTING WATERCRAFT TRANSOM HEIGHT

BACKGROUND OF THE INVENTION

1. Field of the Invention

The invention relates generally to devices and methods for providing a watercraft transom having an adjustable height feature allowing optimal matching with the drive shaft of the watercraft's motor.

2. Description of the Related Art

Outboard watercraft motors are generally available in either a short, long or extra long drive shaft version as further described herein.

As used herein, a short drive shaft outboard may be approximately 15 inches in length. These short drive shafts may be found in use in, e.g. small boats, sailboats with movable brackets, small sailboats, inflatable boats and canoes. These short drive shafts may comprise the primary motor or be used as a trolling motor or other non-primary motor. Generally, the watercraft making use of the short drive shaft outboard motors comprise an aft transom that is approximately 15 to 17 inches in height.

Long drive shafts, as that term is used herein, for available outboard motors may comprise a drive shaft that is approximately 20 inches in length. Such long drive shaft outboard motors may be found in use with, without limitation, sailboats, and pontoons. The watercraft using the 20-inch long drive shaft outboard motors generally comprise an aft transom that is approximately 18 to 21 inches in height.

Finally, extra long drive shafts for available outdoor motors may comprise a drive shaft that is approximately 25 inches in length. Outboard motors comprising the long drive snail may be found in use with pontoons, catamarans, sailboats, large barges and other watercraft having a relatively high transom, i.e., wherein the transom is between 21 to 27 inches in height.

When a watercraft owner selects an outboard motor to match with the watercraft for optimal performance, it is critical to measure the watercraft's transom as well as the motor, specifically the drive shaft length, to make sure the motor will fit the watercraft's transom. With outboard motors, the most important measurement is the drive shaft length. Mismatching the outboard motor drive shaft length with the transom height can result in poor performance. For example, an outboard with a shaft length that is too short for the watercraft will cause the propeller to lift out of the water when the watercraft is on plane, compromising performance.

Outboard motor drive shafts are thus optimally individually fitted to a watercraft according to the boat's aft transom height. When a watercraft lifts under power and skims across the water, it performs and handles most efficiently when the propeller is the only engine part remaining in the water. For this reason, the shaft length must match the height of a watercraft's aft transom. This general and known concept is illustrated in FIG. 1. There the transom height T is indicated with an outboard motor having a matched, fixed non-adjustable drive shaft length S, wherein S≈T. Drive shaft length S is generally measured from the top of the transom to the cavitation plate. Transom height T is generally measured from the top to the bottom of the aft transom. Thus T is approximately equal to S in the optimal configuration of FIG. 1. Currently, however, this optimized match between transom height and outboard motor drive shaft length S is, unfortunately, not easily achieved in many cases.

Table 1 below illustrates some available combinations of transom height and the closest available outboard motor drive shaft length:

TABLE 1

| Typical Fixed Non-Adjustable Transom Height Ranges: | Currently Avilable Outboard Drive shaft Length: |
|---|---|
| 14"-17.25" | 15" Shaft (Short) |
| 17.25"-19.5" | No Optimal Match, must choose either 15" or 20" |
| 19.5"-22.5" | 20" Shaft (Long) |
| 22.5"-27" | 25" Shaft (Extra-Long) |

Table 1 illustrates the basic problem: for many current applications, the transom height vs. drive shaft length is mismatched, resulting in sub-optimal watercraft performance.

To illustrate in terms of the state of the art, we refer now to the typical construction strategy on, e.g., a pontoon watercraft that is designed for use with an extra long drive shaft outboard motor, i.e., the drive shaft length is approximately 25 inches. This exemplary pontoon would optimally comprise an aft transom that is fixed at approximately 25 inches to provide optimal matching between drive shaft length and transom height. If, on the other hand, the exemplary pontoon watercraft is being designed for use with a long drive shaft outboard motor with a drive shaft, length of 20 inches, the fixed transom height will be designed to compensate with a height of approximately 20 inches to optimally match the drive shaft length and transom height. Thus, in both of these cases, S≈T as illustrated in exemplary FIG. 1.

In these known cases, the transom height is always fixed, i.e., not adjustable in height, and is manufactured to fit an outboard motor comprising a known and specified drive shaft length that is also always fixed. At times, the watercraft user may subsequently wish to switch from a short drive shaft outboard motor to a long drive shaft outboard motor, from a long to an extra long drive shaft, etc. In this event, the fixed, non-adjustable transom height is no longer optimal with adverse impact on the watercrafts performance. Currently, correction of this mismatching between the transom height T and new drive shaft length S requires modifying the transom height T to re-optimize its match with the length S of the new outboard motor's drive shaft. Modification of the transom height T requires cutting and fabrication of components to make the conversion and adjustment. Such conversion is difficult and expensive.

The present invention addresses these problems.

BRIEF SUMMARY OF THE INVENTION

The invention provides devices and methods for providing a watercraft transom having an adjustable transom height feature allowing optimal matching with the drive shaft of the watercraft's motor in one embodiment, the adjustable transom height feature comprises two transom height settings to accommodate long or extra long drive shafts or, alternatively short or long or, still more alternatively, short or extra long drive shafts. In another embodiment, the adjustable transom height feature comprises more than two transom height settings, preferably to include matching transom height to known and available outboard motor drive shafts in order to accommodate and virtually optimize any drive shaft length.

The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

Figure 2B:
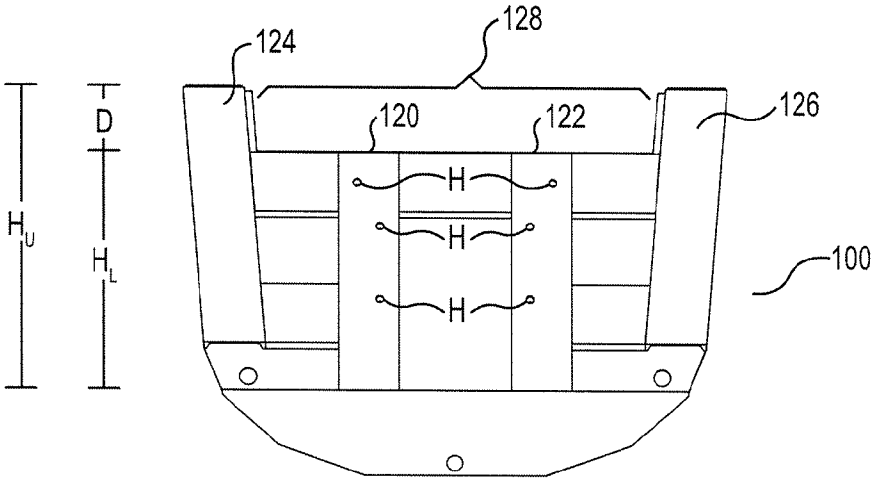
FIG. 2B is a front view of one embodiment of the present invention.
Figure 2C:
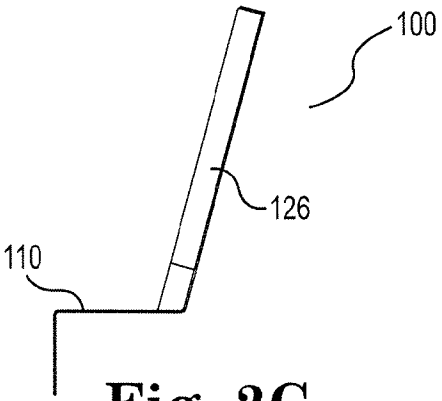
FIG. 2C is a side view of one embodiment of the present invention.
Figure 2A:
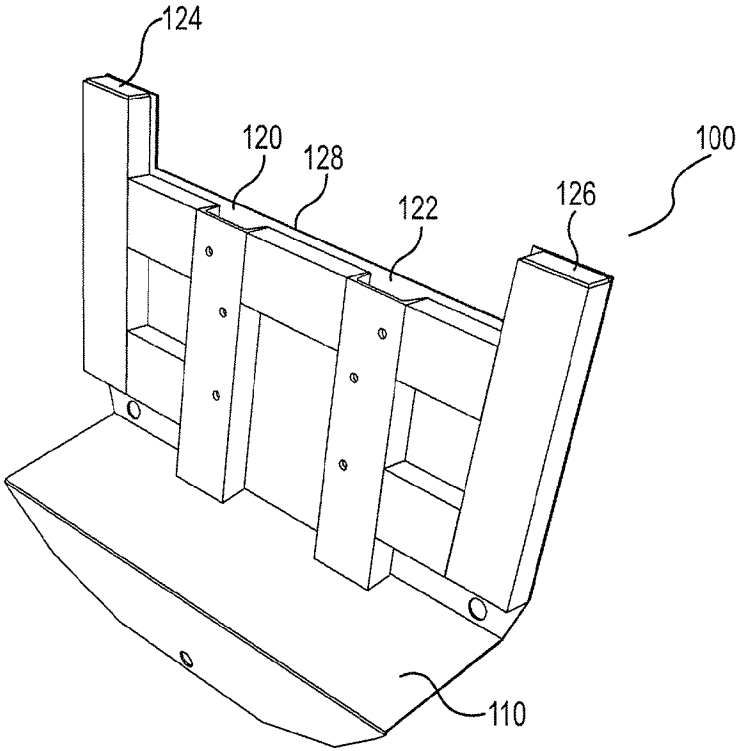
FIG. 2A is a perspective view of one embodiment of the present invention.

FIGS. 2A-2C illustrate one embodiment of a lower member 100 of one embodiment of the present invention. Lower member 100 comprises a lower transom plate 110 with left and right hollow inner center channels 120, 122 attached thereto. In addition, left and right outer vertical support members 124, 126 are in fixed attachment with the lower transom plate 110 and with the left and right hollow center channels 120, 122.

Left and right hollow inner center channels 120, 122 comprise a lower height $H_L$ while outer vertical support members 124, 126 comprise an upper height $H_U$. A lower mount ledge 128 is therefore provided disposed between the outer vertical support members 124, 126 and with height matching that of the left and right hollow inner center channels 120, 122, i.e., $H_L$. Left and right hollow inner center channels 120, 122 may further comprise a series of through holes in matched pairs H, aligned horizontally and vertically for securement of an upper member to lower member 100 at varying heights as will be discussed further below.

The difference D between $H_L$ and $H_U$ comprises in certain embodiments, the difference in outboard motor drive shaft lengths. For example, in various embodiments, $H_U$–$H_L$ may comprise one of the following exemplary configurations:

TABLE 2

| Exemplary Pair of Outboard Motor Drive shaft Lengths | Upper Height ($H_U$) | Lower Height ($H_L$) | $H_U - H_L$ |
|---|---|---|---|
| 25 Inches or 20 Inches | 25 Inches | 20 Inches | 5 Inches |
| 20 Inches or 15 Inches | 20 Inches | 15 Inches | 5 Inches |
| 25 Inches or 15 Inches | 25 Inches | 15 Inches | 10 Inches |

Figure 1:
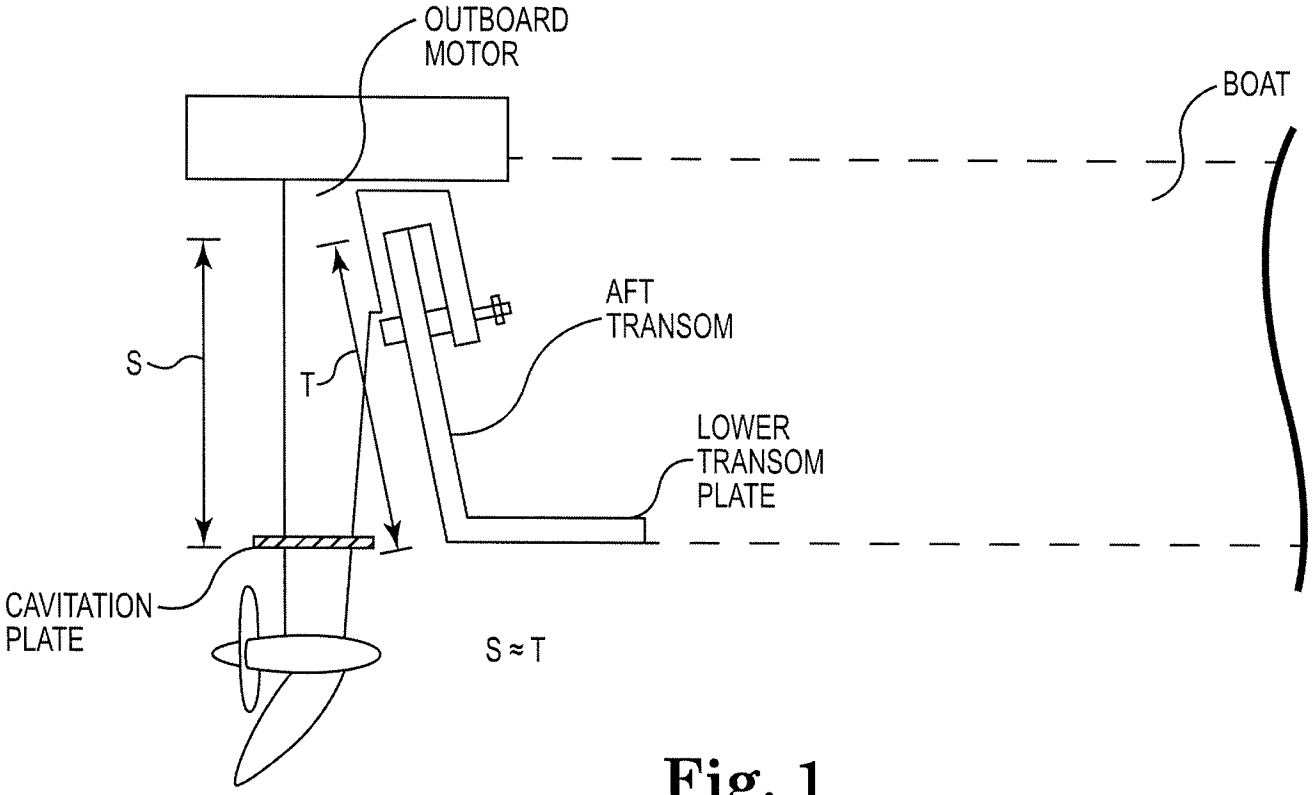
Fig. 1 (PRIOR ART)
FIG. 1 is a partial cutaway side view of a prior art outboard motor and transom configuration.

Thus, in each of these exemplary configurations shown in Table 2, the Upper Height $H_U$ matches the longer of the two exemplary drive shafts, while the Lower Height $H_L$ matches the shorter of the two exemplary drive shafts. The difference D, i.e., $H_U$–$H_L$, is therefore equal to the difference between the lengths of the two exemplary drive shafts in an optimal configuration where, as in FIG. 1, drive shaft length (S)≈transom height (T).

Figure 3B:
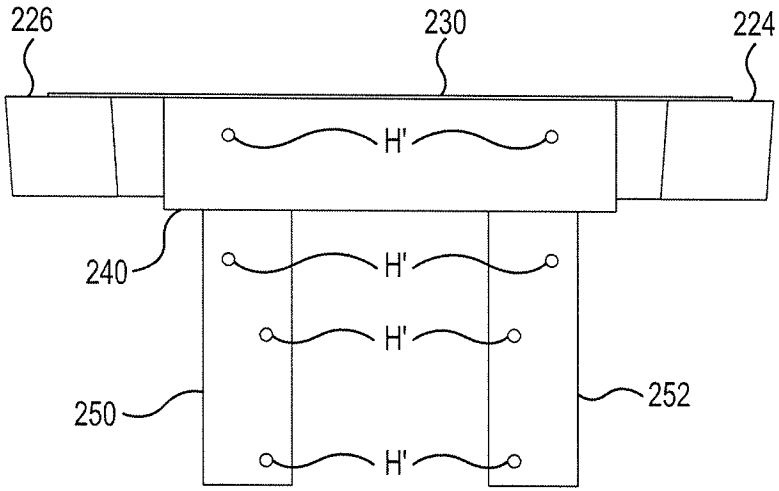
FIG. 3B is a front view of one embodiment of the present invention.
Figure 3C:
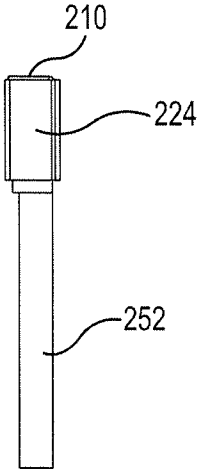
FIG. 3C is a side view of one embodiment of the present invention.
Figure 3A:
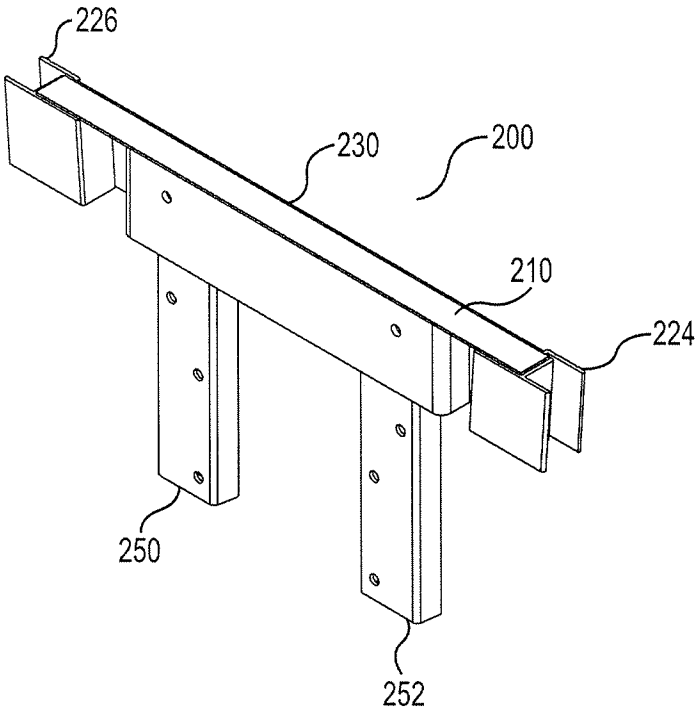
FIG. 3A is a perspective view of one embodiment of the present invention.
Figure 4:
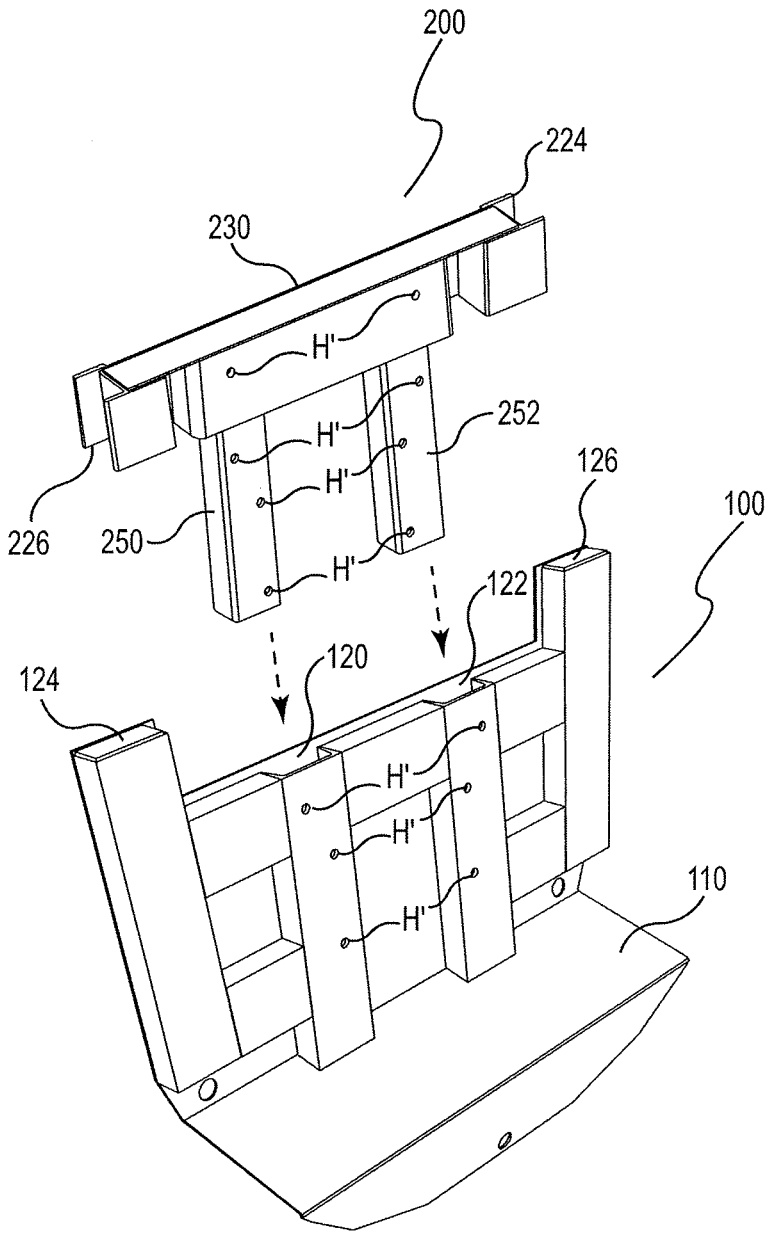
FIG. 4 is a perspective view of one embodiment of the present invention.

Turning now to FIGS. 3A-3C, one embodiment of the upper member 200 is illustrated. Upper member 200 comprises an upper transom plate 210 with right and left sides 220, 222, with right and left vertical guide channels 224, 226 mounted on the right and left sides 220, 222, respectively, of upper member 200. Upper member 200 further comprises a top side 230 and a bottom side 240. Left and right vertical stakes, 250, 252 are attached to the upper transom plate 210. As illustrated, vertical stakes 250, 252 are attached to the bottom side 240 of upper transom plate 210. A plurality of matched pair throughholes H' are provided in at least the vertical stakes 250, 252 for securement within lower member 100.

Vertical stakes 250, 252 are configured so that left vertical stake 250 slidingly fits within left hollow inner center channel 120 of lower member 100. Similarly, right vertical stake 262 is configured to slidingly fit within the right hollow inner center channel 122 of lower member 100. As illustrated, the geometrical shape and profile of right and left hollow inner center channel 120, 122 are complementary with right and left vertical stakes 250, 252, respectively.

Further, in the illustrated embodiment, right and left vertical guide channels 224, 226 slidingly receive at least part of the right and left outer vertical support members 126, 124, respectively.

Figure 5:
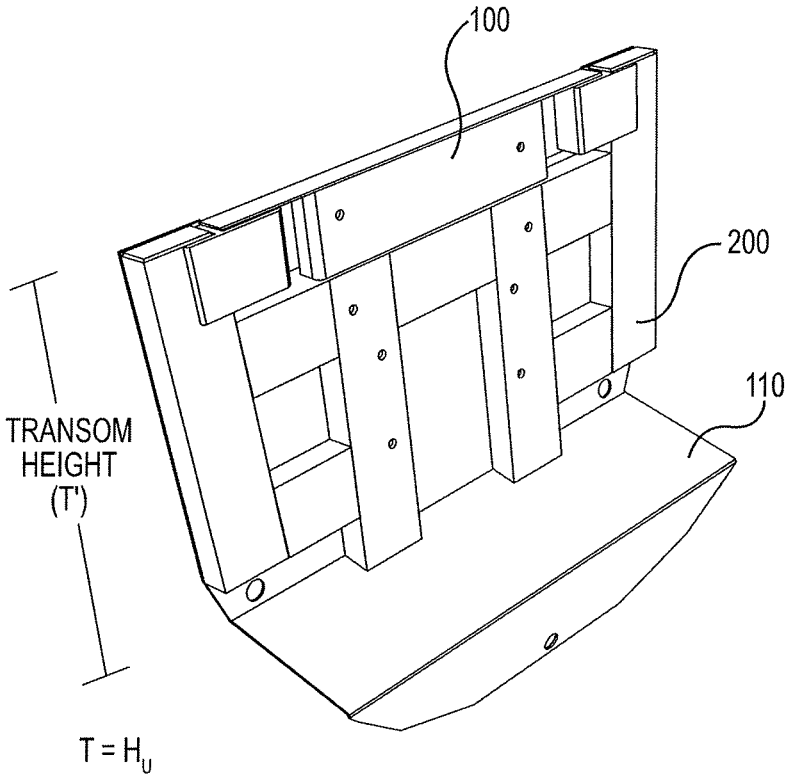
FIG. 5 is a perspective view of one embodiment of the present invention.

With continued reference to FIGS. 2A-2C and 3A-3C, FIG. 4 illustrates the upper and lower members 100, 200 just prior to lowering upper member 100 into engagement with lower member 200. Similarly, FIG. 5 illustrates the adjustable transom 300 with upper member 100 fully engaged with lower member 200. In FIG. 5, lower member's matched throughhole pairs H are in full alignment with all of the upper member's matched throughhole pairs H', allowing bolting securement therethrough, connecting and securing upper member 100 to lower member 200 in fixed position. This configuration is one exemplary position of the present invention, comprising a height from the lower transom plate 110 of the lower member 100 to the top side 230 of the upper member 200 as shown in FIG. 5. Thus, this illustrated height comprises the transom height T.

Further, the throughholes on right and left vertical stakes 260, 252 are aligned with the througholes on the right and left hollow inner center channels 120, 122 when the right and left vertical stakes 250, 252 are fully engaged within inner center channels 120, 122. This full engagement results in the bottom side 240 of upper transom place 210 engaging the upper side of lower member 100. As discussed above, this embodiment of the present invention may comprise a fixed transom height T, i.e., height that is customized to fit a particular drive shaft length for the proposed watercrafts outboard motor. In this case, the fixed transom height T is equal to the Upper Height $H_U$ that is discussed supra, wherein the outboard motor rests on the top side 230 of upper member 200.

Figure 6:
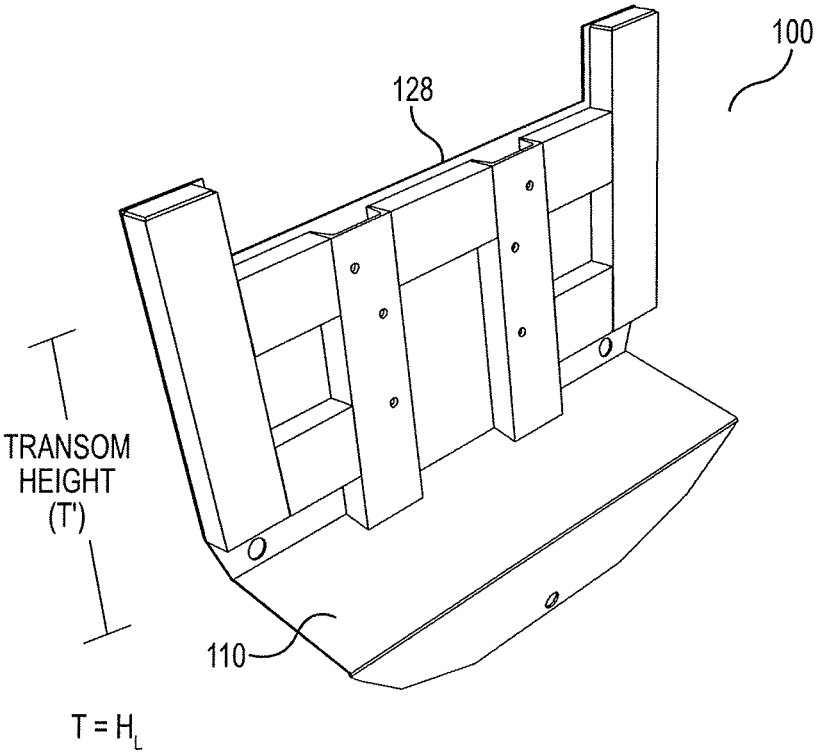
FIG. 6 is a perspective view of one embodiment of the present invention.

Alternatively, as in FIG. 6, the upper member 200 may be omitted, creating a lower transom height T that is equal to the lower Height $H_L$ that is discussed supra, wherein the outboard motor rests on lower mount ledge 128 of lower member 100.

In this embodiment, the invention comprises two possible, but still fixed and otherwise non-adjustable transom height positions: a longer transom height T corresponding to $H_U$ and a shorter transom height T' corresponding to $H_L$.

Thus, one embodiment of the present invention comprises an adjustable height transom with at least two positions: a first position with the upper member 200 fully engaging and received within the lower member 100, and a second position without the upper member 200 engaging the lower member 100. The first position, with lower and upper members 100, 200 in engagement, thus comprises a transom height that is higher than that of the second position, i.e., without the upper member 200. The upper and lower heights for this embodiment of the present invention may comprise the transom heights illustrated above in Table 2 in order to capture the most common drive shaft lengths S and provide optimal performance.

As a result, the following optimal transom height combination pairs may be realized:

An upper transom height of 25 inches and a lower transom height of 15 inches;

An upper transom height of 25 inches and a lower transom height of 20 inches; and An upper transom height of 20 inches and a lower transom height of 15 inches.

Additional transom height pairings are certainly possible and well within the scope of the present invention. The illustrated transom height pairing combinations are provided to match with the most commonly available outboard drive shaft lengths S as illustrated in Table 2.

Referring back to Table 1 which illustrates various combinations of outboard motor drive shaft length S and transom height T. In order to provide maximum, flexibility in matching the transom height H with the drive shaft length S, an additional embodiment of the present invention comprises multiple fixed transom height positions. Another embodiment of the present invention may provide selectably adjustable transom heights. We now describe this embodiment, with continued reference to FIGS. 2A-2C, 3A-3C and 4.

In the selectably adjustable embodiment, upper member 200 is at least partially engaged with, and received by, lower member 100 in the manner described above. The difference between the currently illustrated embodiment and the above-described embodiments is that there are more than two, and preferably a plurality, of transom heights that may be obtained with the current embodiment, dependent upon the outboard motor's drive shaft length S in order to provide optimal watercraft performance. This adjustability is achieved by the plurality of througholes pairs H' on right and left stakes 252 and 250 of upper member 200, at least one of such pairs H' successively match with at least one of the throughholes H of right and left inner channels 122, 120. As the stakes 252, 250 of upper member 100 are slidingly received within right and left inner channels 122, 120, the upper member throughhole pairs H' will begin to match with at least one throughole pair H of the lower member 200. Each such successive matching of H' and H pairs corresponds with a variable transom height, as measured from the lower transom plate 110 to the top side 230 of upper member 200 as shown in FIG. 5.

The skilled artisan will now readily recognize that the upper member 200 may be lowered to a variety of positions slidingly engaged within the lower member 100 in order to achieve a selectable transom height that most closely matches the outboard motor's drive shaft length S. Sliding the upper member 200 further into the inner channels 120, 122 of lower member 100 to the next successive matching of throughhole pairs H' and H results in a correspondingly lowered transom height.

Consequently, this embodiment of the present invention may comprise a selectably variable transom height in the range of 15 inches to 25 inches in order to cover the most commonly available outboard motor drive shaft lengths of 15 inches, 20 inches and 25 inches, as well as selectable heights between 15 inches and 20 inches and between 20 inches and 25 inches. Further, the selectable variable transom height may be within a range of 14 inches to 27 inches, in order to cover not only the most common drive shaft lengths of 15, 20 and 25 inches, but also some older drive shaft lengths that may be utilized.

Further, in all embodiments, the skilled artisan will recognize that the upper member may be an optional element in the case where the drive shaft length is equal to that of the lower height in this case, the lower member is all that is required to optimize current performance. However, should the watercraft owner want to change outboard motors from, e.g., a 15 inch short shaft to a 20 inch or 25 inch, or other length, drive shaft, the upper member will be employed to provide a selectably variable upper height to accommodate the longer drive shaft length(s).

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives failing within the spirit and scope of the invention.

What is claimed is:

1. An aft transom with an upper and lower height adjustment for a watercraft for attaching an outboard motor thereto, comprising:

a lower member comprising a lower transom plate;

right and left hollow inner channel members attached to the lower transom plate, each of the right and left hollow inner channel members having a height and one or more througholes, a lower mount ledge corresponding to a lower transom height and further correspondent with the height of the right and left inner channel members, right and left outer vertical support members attached to the lower transom plate and to the right and left hollow inner channel members, the right and left vertical support members comprising a lower transom height, wherein the lower transom height may be matched with a drive shaft length of an outboard motor to be attached to the watercraft's transom to the lower mount ledge;

an upper member comprising an upper transom plate having right and left sides, a right vertical guide channel mounted on the right side of the upper transom plate, a left vertical guide channel mounted on the left side of the upper transom plate, left and right vertical stakes attached to the upper transom plate, each of the left and right vertical stakes comprising at least one throughole, the left and right vertical stakes capable of slidingly engaging the left and right hollow channel members, respectively, of the lower member, wherein the at least one through hole in each of the left and right vertical stakes matches with the at least one through hole of the left and right hollow channel members when the upper member is fully slidingly received within the lower member, whereby the lower member is secured to the upper member with bolts, and wherein the upper transom height is matched with a drive shaft length of an outboard motor to be attached to the watercraft's transom of the upper transom plate.

2. The aft transom of claim 1, further comprising:

the upper member's right and left vertical stakes having a plurality of through holes; and the lower member's left and right hollow channel members having a plurality of through holes, wherein, the through holes of the upper member match with the through holes of the lower member as the upper member slidingly engages the lower member, and whereby the upper member may be boltingly secured to the lower member at each of the matches of the upper member and lower member through holes during the sliding engagement.

3. The aft transom of claim 1, wherein the upper transom height is 25 inches.

4. The aft transom of claim 3, wherein the lower transom height is 15 inches.

5. The aft transom of claim 3, wherein the lower transom height is 20 inches.

6. The aft transom of claim 1, wherein the upper transom height is 20 inches.

7. The aft transom of claim 6, wherein the lower transom height is 15 inches.

8. The aft transom of claim 2, wherein the transom height is selectably variable within the range of 15 inches to 25 inches.

9. The aft transom of claim 2, wherein the transom height is selectably variable within the range of 14 inches to 27 inches.

10. The aft transom of claim 2, wherein the transom height is selectable between 15 inches, 20 inches and 25 inches.

11. An aft transom with an upper and lower height adjustment for a watercraft for attaching an outboard motor thereto, comprising:

a lower member comprising a lower transom plate;

right and left hollow inner channel members attached to the lower transom plate, each of the right and left hollow inner channel members having a height and a plurality of througholes, a lower mount ledge corresponding to a lower transom height and further correspondent with the height of the right and left inner channel members, right and left outer vertical support members attached to the lower transom plate and to the right and left hollow inner channel members, the right and left vertical support members comprising a lower transom height, wherein the lower transom height may be matched with a drive shaft length of an outboard motor to be attached to the watercraft's transom to the lower mount ledge;

an upper member comprising an upper transom plate having right and left sides, a right vertical guide channel mounted on the right side of the upper transom plate, a left vertical guide channel mounted on the left side of the upper transom plate, left and right vertical stakes attached to the upper transom plate, each of the left and right vertical stakes comprising a plurality of througholes, the left and right vertical stakes capable of slidingly engaging the left and right hollow channel members, respectively, of the lower member, wherein the at least one through hole in each of the left and right vertical stakes matches with the at least one through hole of the left and right hollow channel members when the upper member is fully slidingly received within the lower member, whereby the lower member is secured to the upper member with bolts, and wherein the upper transom height is variably selectable to match with a drive shaft length of an outboard motor to be attached to the watercraft's transom of the upper transom plate.

12. The aft transom of claim 11, wherein the upper transom height is selectable between 25 inches and 20 inches, and wherein the lower transom height is 15 inches.

13. The aft transom of claim 11, wherein the lower transom height is 15 inches and the upper transom height is variably selectable within the range of 20 inches to 25 inches.

14. A method for adjusting the height of a watercraft transom to match the drive shaft length of an outboard motor attached to the transom, comprising:

providing a watercraft and an outboard motor having a drive shaft length, wherein the drive shaft length is either 15 inches, 20 inches or 25 inches;

providing an aft transom on the watercraft comprising a lower member having a lower height of 15 inches;

measuring the drive shaft length;

resting the outboard motor having the drive shaft length of 15 inches on a lower mount ledge of the lower member having the lower height of 15 inches;

for the outboard motor having the 20 inch or the 25 inch drive shaft:

providing an optional upper member configured for slidable engagement with the lower member and having a selectably adjustable upper height of either 20 inches or 25 inches;

engaging the lower member and at least a portion of the upper member with each other;

aligning matched pairs of throughholes in the lower and upper members with each other;

securing the lower and upper members to each other such that the upper height is either 20 inches or 25 inches; and resting the outboard motor having the drive shaft length of 20 inches or 25 inches on a top side of the upper member having a corresponding upper height of 20 inches or 25 inches.

* * * * *